US008711047B2

(12) United States Patent
Tran

(10) Patent No.: US 8,711,047 B2
(45) Date of Patent: Apr. 29, 2014

(54) ORTHOGONAL TUNABLE ANTENNA ARRAY FOR WIRELESS COMMUNICATION DEVICES

(75) Inventor: Allen Minh-Triet Tran, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 504 days.

(21) Appl. No.: 12/404,182

(22) Filed: Mar. 13, 2009

(65) Prior Publication Data

US 2010/0231472 A1 Sep. 16, 2010

(51) Int. Cl.

*H01Q 11/12* (2006.01)
*H01Q 7/00* (2006.01)
*H01Q 21/00* (2006.01)

(52) U.S. Cl.

USPC ..... 343/742; 343/750; 343/751; 343/741; 343/855; 343/866; 343/748

(58) Field of Classification Search

USPC ..... 343/742, 750, 751, 741, 748, 855, 866, 343/867

See application file for complete search history.

(56) References Cited

U.S. PATENT DOCUMENTS

| | | | | |
|---|---|---|---|---|
| 2,093,158 | A * | 9/1937 | Pratt | 336/123 |
| 4,054,881 | A | 10/1977 | Raab | |
| 5,945,964 | A | 8/1999 | DeGroot et al. | |
| 6,005,532 | A * | 12/1999 | Ng | 343/867 |
| 6,151,354 | A | 11/2000 | Abbey | |
| 6,317,091 | B1 * | 11/2001 | Oppelt | 343/742 |
| 6,339,399 | B1 | 1/2002 | Andersson et al. | |
| 6,476,769 | B1 | 11/2002 | Lehtola | |
| 7,202,790 | B2 | 4/2007 | Copeland et al. | |
| 7,801,556 | B2 | 9/2010 | Tran | |
| 2002/0183013 | A1 | 12/2002 | Auckland et al. | |
| 2003/0050032 | A1 | 3/2003 | Masaki | |
| 2003/0193437 | A1 | 10/2003 | Kangasvieri et al. | |
| 2004/0072542 | A1 | 4/2004 | Sanford | |
| 2004/0130496 | A1 | 7/2004 | Iijima et al. | |
| 2004/0198473 | A1 | 10/2004 | Tran | |

(Continued)

FOREIGN PATENT DOCUMENTS

| | | |
|---|---|---|
| CN | 1618186 A | 5/2005 |
| DE | 8814993 | 4/1989 |

(Continued)

OTHER PUBLICATIONS

Written Opinion of the International Search Authority, application PCT/US2010/027353, Sep. 13, 2011.*

(Continued)

*Primary Examiner* — Dameon Levi
*Assistant Examiner* — Jennifer F Hu
(74) *Attorney, Agent, or Firm* — Ramin Mobarhan

(57) ABSTRACT

A multi-band antenna array for use in wireless communication devices with up to three simultaneous operating modes with improved antenna efficiency and reduced antenna coupling across a broad range of operative frequency bands with reduced physical size is described. The multi-band antenna array includes at least two loop antenna elements, each of which is orthogonal to, and arranged in an embedded manner, relative to each other. Each loop antenna in the multi-band antenna array may include a corresponding tuning element for tuning to a desired resonant frequency, and be comprised of an upper and lower half with the corresponding tuning element coupled therebetween.

14 Claims, 6 Drawing Sheets

(56) References Cited

U.S. PATENT DOCUMENTS

| | | | | |
|---|---|---|---|---|
| 2005/0085204 | A1 | 4/2005 | Poilasne et al. | |
| 2005/0164647 | A1 | 7/2005 | Shamsaifar | |
| 2006/0132360 | A1 | 6/2006 | Caimi et al. | |
| 2006/0281423 | A1 | 12/2006 | Caimi et al. | |
| 2007/0139276 | A1 | 6/2007 | Svigelj et al. | |
| 2008/0211320 | A1 | 9/2008 | Cook et al. | |
| 2008/0287084 | A1 * | 11/2008 | Krebs et al. | 455/271 |
| 2012/0062436 | A1 | 3/2012 | Kimura et al. | |

FOREIGN PATENT DOCUMENTS

| | | | |
|---|---|---|---|
| DE | 19533105 | | 10/1996 |
| DE | 19844762 | B4 | 2/2005 |
| EP | 0892459 | | 1/1999 |
| EP | 1455459 | A1 | 9/2004 |
| EP | 1641140 | A1 | 3/2006 |
| EP | 1944827 | A2 | 7/2008 |
| JP | S59101508 | U | 7/1984 |
| JP | 08097624 | | 4/1996 |
| JP | H08293725 | A | 11/1996 |
| JP | 10190345 | | 7/1998 |
| JP | H11194172 | A | 7/1999 |
| JP | 2001136026 | | 5/2001 |
| JP | 2001344574 | A | 12/2001 |
| JP | 2002319815 | | 10/2002 |
| JP | 2003298348 | A | 10/2003 |
| JP | 2004328285 | | 11/2004 |
| JP | 2004328666 | | 11/2004 |
| JP | 2005514844 | | 5/2005 |
| JP | 2005210568 | | 8/2005 |
| JP | 2006339769 | A | 12/2006 |
| JP | 2007068005 | A | 3/2007 |
| JP | 2007328634 | A | 12/2007 |
| KR | 20060029688 | A | 4/2006 |
| KR | 1020080065914 | A | 7/2008 |
| KR | 20080081174 | A | 9/2008 |
| TW | 419859 | | 1/2001 |
| WO | WO03071713 | A1 | 8/2003 |
| WO | WO2005006579 | | 1/2005 |

OTHER PUBLICATIONS

International Search Report & Written Opinion—PCT/US2010/027353, International Search Authority—European Patent Office—May 21, 2010.

Taiwan Search Report—TW099107520—TIPO—Nov. 18, 2013.

* cited by examiner

ORTHOGONAL TUNABLE ANTENNA ARRAY FOR WIRELESS COMMUNICATION DEVICES

TECHNICAL FIELD

The present disclosure relates generally to radio frequency (RF) antennas, and more specifically to multi-band RF antennas.

BACKGROUND

In many wireless communication devices there is a requirement to support multiple frequency bands and operating modes. Some examples of operating modes include multiple voice/data communication links (WAN or wide-area network)—GSM, CDMA, WCDMA, LTE, EVDO—each in multiple frequency bands (CDMA450, US cellular CDMA/GSM, US PCS CDMA/GSM/WCDMA/LTE/EVDO, IMT CDMA/WCDMA/LTE, GSM900, DCS), short range communication links (Bluetooth, UWB), broadcast media reception (MediaFLO, DVB-H), high speed internet access (UMB, HSPA, 802.11a/b/g/n, EVDO), and position location technologies (GPS, Galileo). With each of these operating modes in a wireless communication device, the number of radios and frequency bands is incrementally increased and the complexity and design challenges for a multi-band antenna supporting each frequency band as well as potentially multiple antennas (for receive and/or transmit diversity, along with simultaneous operation in multiple modes) may increase significantly.

One solution for a multi-band antenna is to design a structure that resonates in multiple frequency bands. Controlling the multi-band antenna input impedance as well as enhancing the antenna radiation efficiency (across a wide range of operative frequency bands) is restricted by the geometry of the multi-band antenna structure and the matching circuit between the multi-band antenna and the radio(s) within the wireless communication device. Often when this design approach is taken, the geometry of the antenna structure is very complex and the physical area/volume of the antenna increases.

In one example, simultaneous operation of a CDMA/WCDMA/GSM (among other possible) transmitter and GPS receiver in a wireless device may be required. In this instance, the isolation between operating bands and modes is very limited for a single multi-band antenna, and simultaneous operation may not be feasible. Therefore, the GPS receiver usually has a separate dedicated antenna; i.e., two separate electrically isolated antennas are required for simultaneous operation of GPS and CDMA/WCDMA/GSM. This example can be extended to other simultaneous operating modes such as CDMA with Bluetooth, MediaFLO, or 802.11a/b/g/n. In each instance, another single-band or multi-band antenna is usually needed if simultaneous operation is required.

With the limitations on designing multi-band antennas with high antenna radiation efficiency and associated matching circuits, another solution is utilizing multiple antenna elements (an array of antenna elements) to cover multiple operative frequency bands. In a particular application, a cellular phone with US cellular, US PCS, and GPS radios may utilize one antenna for each operative frequency band (each antenna operates in a single radio frequency band). The traditional drawbacks to this approach are additional area/volume and the additional cost of multiple single-band antenna elements.

There is a need for a multi-band antenna array that supports simultaneous operation of multiple operating modes without the size penalty of traditional designs. There is also a need for a multi-band antenna with improved radiation efficiency across a broad range of operative frequencies for wireless communication devices.

Figure 1:
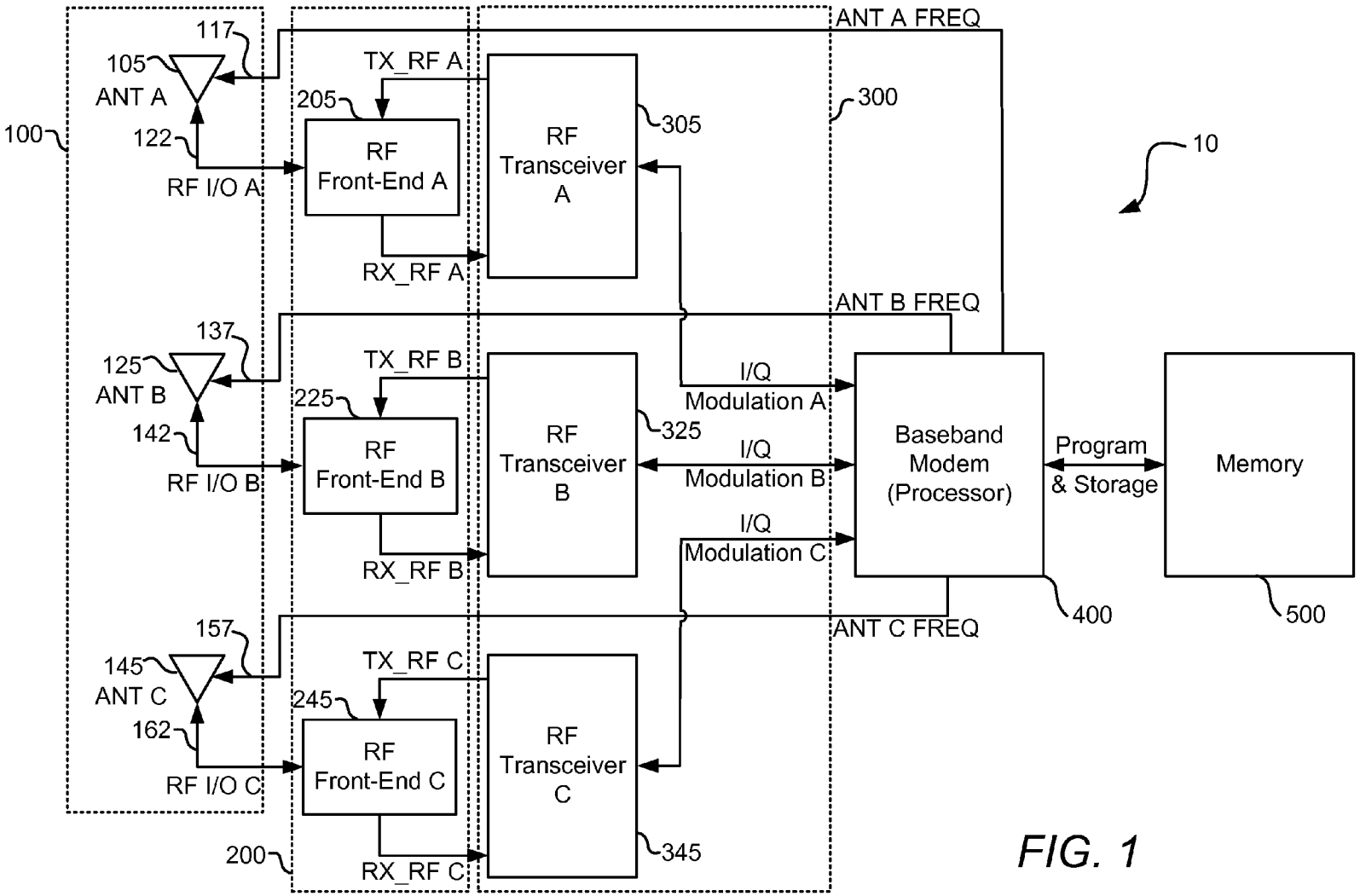
FIG. 1 shows a diagram of a wireless communication device with multiple radios paired with a multi-band antenna array comprised of ANT A, ANT B, and ANT C in accordance with an exemplary embodiment.

To facilitate understanding, identical reference numerals have been used where possible to designate identical elements that are common to the figures, except that suffixes may be added, when appropriate, to differentiate such elements. The images in the drawings are simplified for illustrative purposes and are not necessarily depicted to scale.

The appended drawings illustrate exemplary configurations of the disclosure and, as such, should not be considered as limiting the scope of the disclosure that may admit to other equally effective configurations. Correspondingly, it has been contemplated that features of some configurations may be beneficially incorporated in other configurations without further recitation.

DETAILED DESCRIPTION

The word "exemplary" is used herein to mean "serving as an example, instance, or illustration." Any embodiment described herein as "exemplary" is not necessarily to be construed as preferred or advantageous over other embodiments.

The detailed description set forth below in connection with the appended drawings is intended as a description of exemplary embodiments of the present invention and is not intended to represent the only embodiments in which the present invention can be practiced. The term "exemplary" used throughout this description means "serving as an example, instance, or illustration," and should not necessarily be construed as preferred or advantageous over other exemplary embodiments. The detailed description includes specific details for the purpose of providing a thorough understanding of the exemplary embodiments of the invention. It will be apparent to those skilled in the art that the exemplary embodiments of the invention may be practiced without these specific details. In some instances, well known structures and devices are shown in block diagram form in order to avoid obscuring the novelty of the exemplary embodiments presented herein.

The device described therein may be used for various multi-band antenna array designs including, but not limited to wireless communication devices for cellular, PCS, and IMT frequency bands and air-interfaces such as CDMA, TDMA, FDMA, OFDMA, and SC-FDMA. In addition to cellular, PCS or IMT network standards and frequency bands, this device may be used for local-area or personal-area network standards, WLAN, Bluetooth, & ultra-wideband (UWB) as well as position location technologies (GPS).

FIG. 1 shows a diagram of a wireless communication device with multiple radios paired with a multi-band antenna array (ANT A, ANT B, and ANT C) in accordance with an exemplary embodiment. Wireless communication device 10 supports simultaneous operation of three different radios. An exemplary subset of possible operating modes for wireless communication device 10 is shown in the table below.

| Mode | ANT A | ANT B | ANT C |
|---|---|---|---|
| 802.11n (MIMO) | 2412 MHz | 2412 MHz | 2412 MHz |
| PCS EVDO (RX DIVERSITY) + GPS | 1900 MHz | 1900 MHz | 1575 MHz |
| US CELL CDMA + GPS + BLUETOOTH | 850 MHz | 1575 MHz | 2412 MHz |
| MEDIAFLO + PCS CDMA + BLUETOOTH | 740 MHz | 1900 MHz | 2412 MHz |

Wireless communication device 10 includes a multi-band antenna array 100 (which includes ANT A 105, ANT B 125, and ANT C 145). Multi-band antenna array 100 is connected to RF Front-End array 200 which includes RF Front-End A 205, RF Front-End B 225, and RF Front-End C 245. Wireless communication device RF port A 122, wireless communication device RF port B 142, and wireless communication device RF port C 162 connect between RF Front-End array 200 and the radio frequency inputs of ANT A 105, ANT B 125, and ANT C 145, respectively.

RF Front-End array 200 separates transmit and receive RF signal paths, and provides amplification and signal distribution. RF signals for transmit, TX_RF (A, B and C), and receive, RX_RF (A, B, and C), are passed between transceiver array 300 and RF Front-End array 200.

Transceiver array 300 which includes RF Transceiver A 305, RF Transceiver B 325, and RF Transceiver C 345 is configured to down-convert RX_RF (A, B, and C) signals from RF to one or more baseband analog I/Q signal pairs (A, B, and C path) for I/Q demodulation by processor 400, which may be a baseband modem or the like.

Transceiver array 200 is similarly configured to up-convert one or more baseband analog I/Q signal pairs (A, B, and C path) from processor 400 to TX_RF (A, B, and C) signals. Baseband analog I/Q signals to be up-converted and down-converted from/to baseband I/Q modulation are shown connected between transceiver array 200 and processor 400.

Memory 500 stores processor programs and data and may be implemented, for example, as a single integrated circuit (IC).

Processor 400 is configured to demodulate incoming baseband receive analog I/Q signal pairs (A, B and C path), encode and modulates baseband transmit analog I/Q signals (A, B, and C path), and run applications from storage, such as memory 500, to process data or send data and commands to enable various circuit blocks, all in a known manner.

Figure 3:
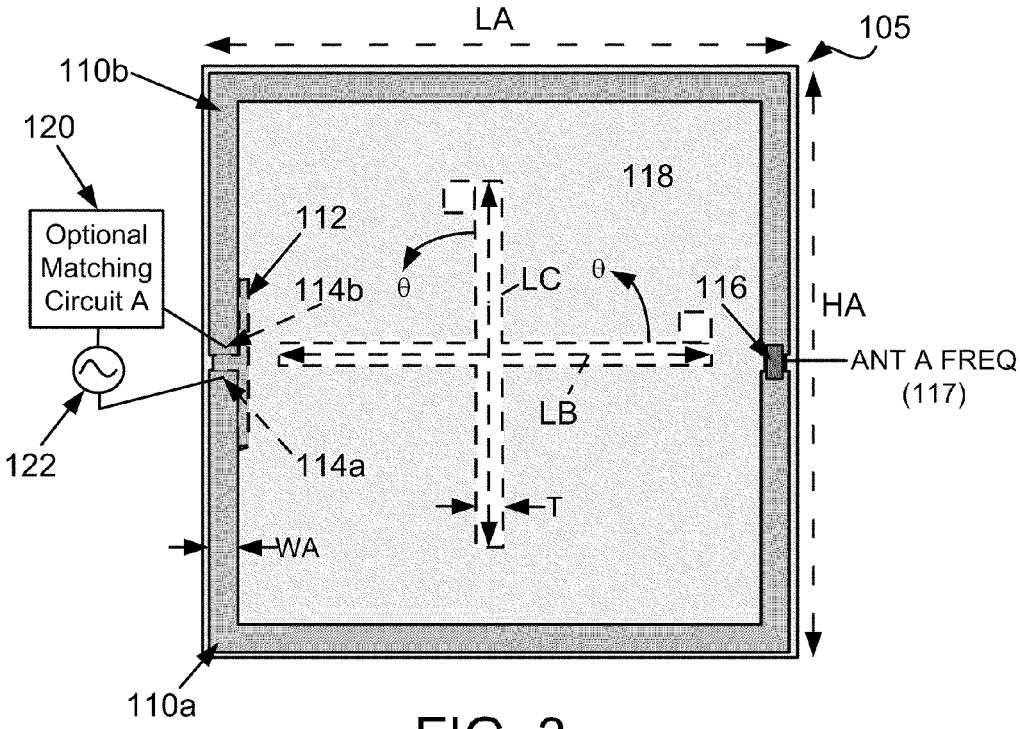
FIG. 3 shows an overhead view (XY plane) of ANT A.
Figure 4:
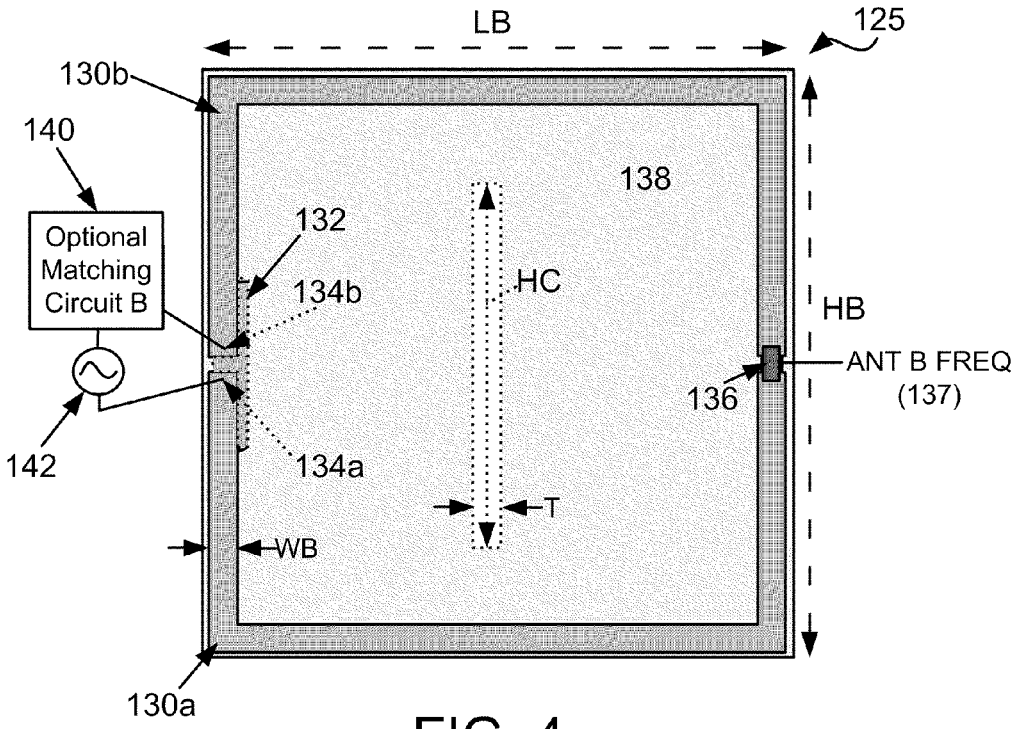
FIG. 4 shows an overhead view (YZ plane) of ANT B.
Figure 5:
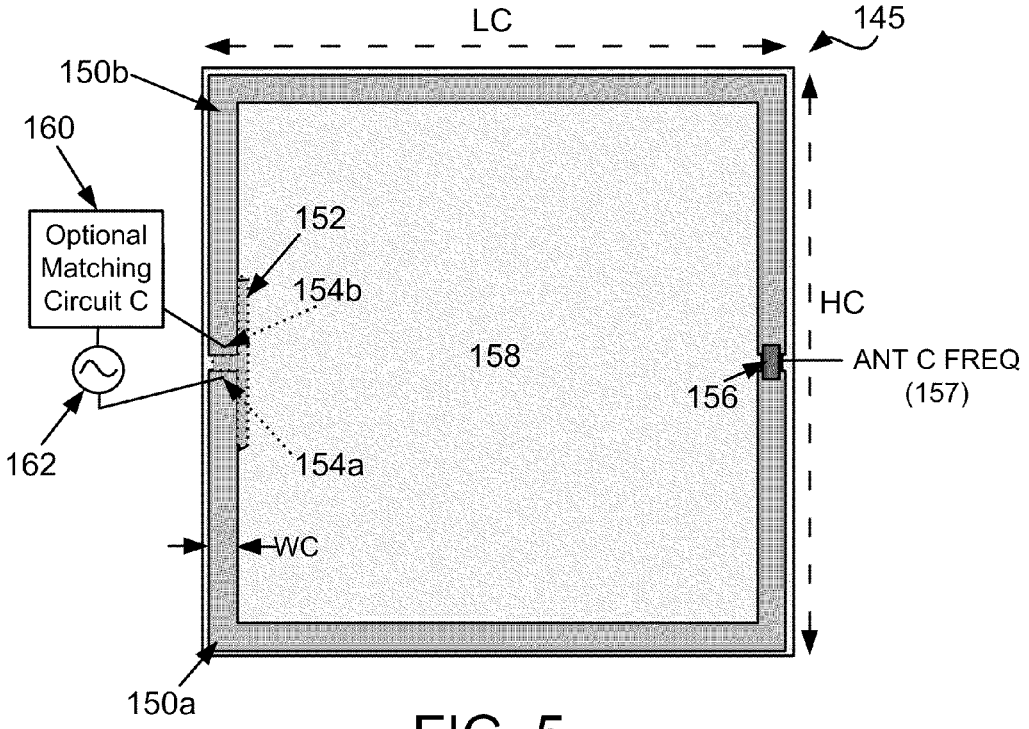
FIG. 5 shows an overhead view (XZ plane) of ANT C.

In addition, processor 400 generates inputs ANT A FREQ 117, ANT B FREQ 137, and ANT C FREQ 157 to multi-band antenna array 100 through a dedicated set of signals as shown in FIG. 1, and in FIGS. 3-5.

ANT A FREQ 117 input is configured to adjust the operating frequency of ANT A 105. ANT B FREQ 137 input is configured to adjust the operating frequency of ANT B 125. ANT C FREQ 157 input is configured to adjust the operating frequency of ANT C 145.

Processor 400 converts the inputs to multi-band antenna array 100 into analog control voltages utilizing digital to analog converters or may send digital control signals directly to multi-band antenna array 100 to discretely adjust the operating frequency of individual antenna elements (ANT A 105, ANT B 125, and/or ANT C 145).

It should be appreciated that the general operation of RF-Front-End array 200, transceiver array 300, processor 400, and memory 500 are well known and understood by those skilled in the art, and that various ways of implementing the associated functions are also well known, including providing or combining functions across fewer integrated circuits (ICs), or even within a single IC.

Alternatively, RF-Front-End array 200, transceiver array 300, processor 400, and memory 500 may be split up into two or more functionally separate blocks if the wireless communication device 10 is split into multiple wireless communication devices for different operating modes. In this instance, the control for individual ANT A 105, ANT B 125 and ANT C 145 may be controlled by individual wireless communication devices.

Figure 2:
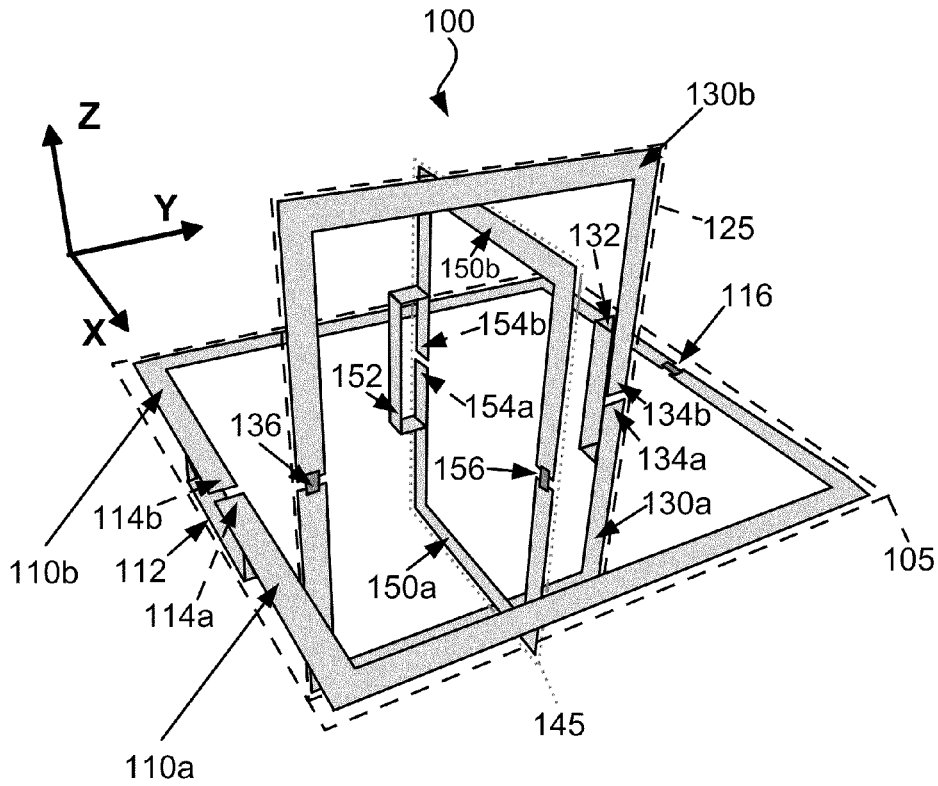
FIG. 2 shows a three dimensional drawing of the multi-band antenna array of FIG. 1.

FIG. 2 shows a three dimensional drawing of the multi-band antenna array 100 in FIG. 1. Multi-band antenna array 100 includes three loop antennas-ANT A 105, ANT B 125, and ANT C 145. Each loop antenna is physically orthogonal to, and arranged in an embedded manner, relative to the other loop antennas in three-dimensional space (XYZ planes). In one exemplary embodiment, multi-band antenna array 100 is formed by selective metallization on a three-dimensional non-metal object.

Referring to FIG. 2, contained within the XY plane, ANT A 105 includes metal strip elements 110*a*, 110*b* and tuning element 116 to form a physical loop structure. An RF feed port for ANT A 105 is composed of two contacts 114*a* and 114*b*. Referring to FIG. 2, metal strap 112 is connected between metal strip elements 110*a* and 110*b* to form a matching circuit between RF feed port contacts 114*a* and 114*b*. Metal strap 112 may be replaced with a lumped element inductor connected between RF feed port contacts 114*a* and 114*b*, however, the electrical loss of the metal strap 112 is much lower than a lumped inductor element and the radiated efficiency of ANT A 105 will suffer some degradation if a lumped inductor element is used.

Figure 6:
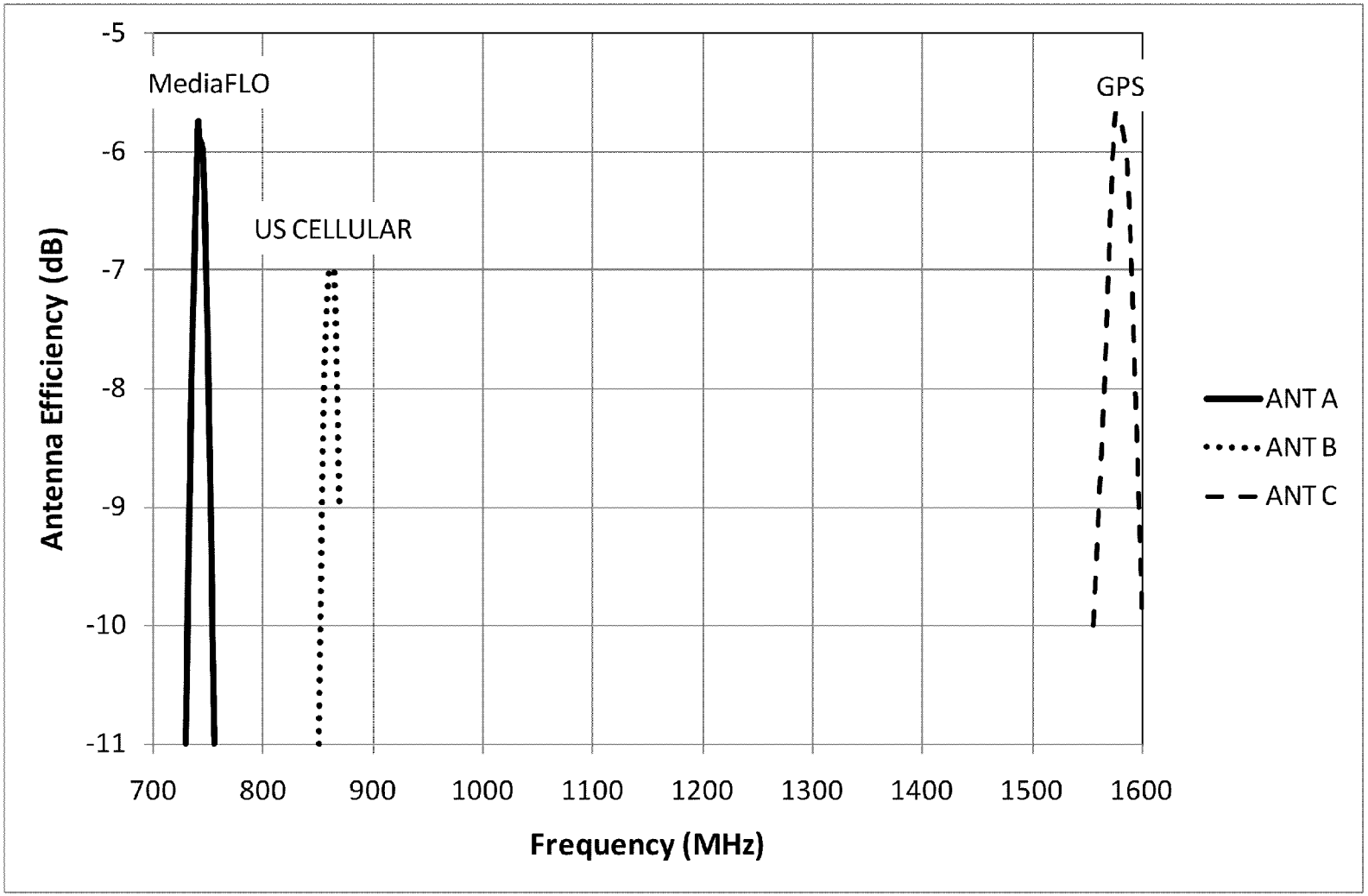
FIG. 6 shows a graph of antenna radiated efficiency from 700 to 1600 MHz for a multi-band array with ANT A, ANT B, and ANT C configured as shown in FIGS. 2-5.
Figure 7:
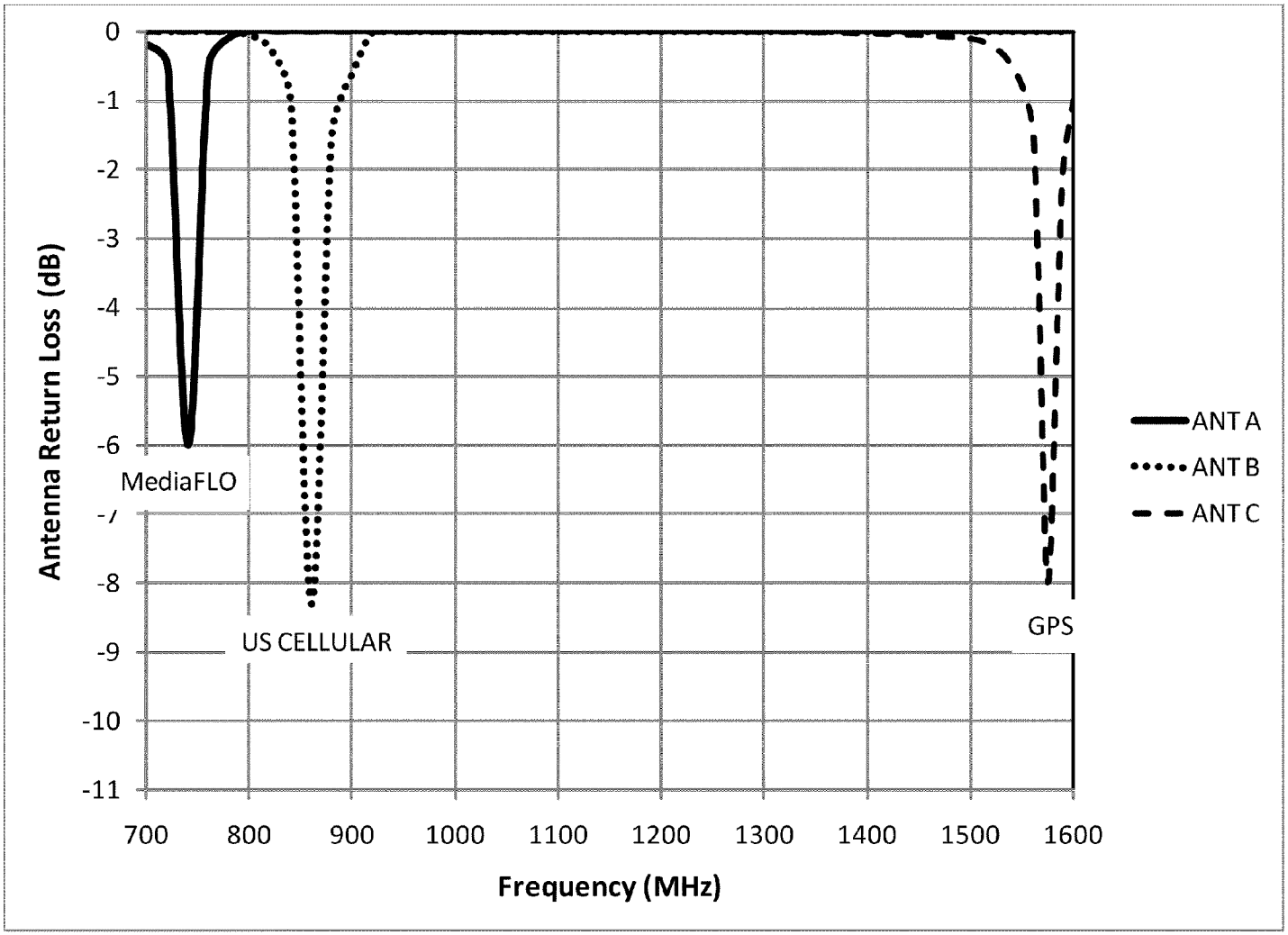
FIG. 7 shows a graph of antenna return loss from 700 to 1600 MHz for a multi-band array 100 with ANT A, ANT B, and ANT C configured as shown in FIGS. 2-5.
Figure 8:
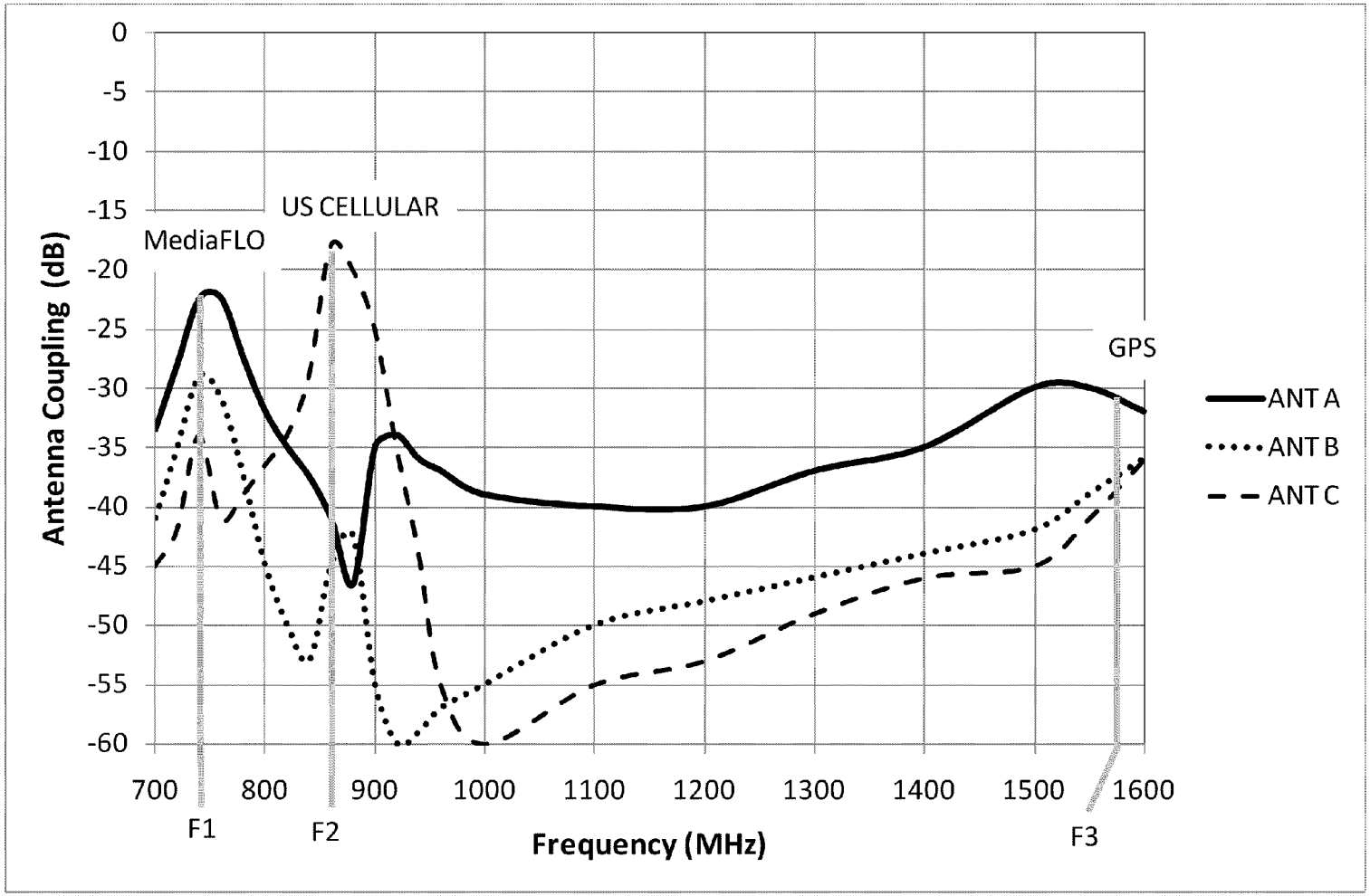
FIG. 8 shows a graph of antenna coupling from 700 to 1600 MHz for a multi-band array 100 with ANT A, ANT B, and ANT C configured as shown in FIGS. 2-5.

Tuning element 116 is a capacitor with a fixed value (lumped capacitor element) or adjustable (using a continuously variable capacitance or a discretely switched capacitor network) depending on the operating band requirements for ANT A 105 as shown in FIGS. 6-8.

In alternate exemplary embodiments, tuning element 116 may be an inductor with a fixed value, or an inductor and capacitor with fixed values (in series or in parallel). The fixed capacitor may be replaced with a continuously variable capacitor or a discretely switched capacitor network for multi-band frequency tuning. The continuously variable capacitor may be composed, but not limited to, one or more varactors, Ferro-electric capacitors, or analog MEM capacitors.

ANT B 125 includes metal strip elements 130*a*, 130*b* and tuning element 136 to form a loop small enough to fit within the physical constraints of ANT A 105. An RF feed port for ANT B 145 is composed of two contacts 134*a* and 134*b*. ANT B 125 may be rotated along the z-axis in other exemplary embodiments (not shown).

Metal strap 132 is connected between metal strip elements 130*a* and 130*b* to form a matching circuit between RF feed port contacts 134*a* and 134*b*. Metal strap 132 may be replaced with a lumped element inductor connected between RF feed port contacts 134*a* and 134*b*, however, the electrical loss of the metal strap 132 is much lower than a lumped element inductor and the radiated efficiency of ANT B 125 may suffer some degradation if a lumped inductor element is used (same as ANT A 105).

Tuning element 136 is a capacitor with a fixed value (lumped capacitor element) or adjustable (using a continuously variable capacitance or a discretely switched capacitor network) depending on the operating band requirements for ANT B 125 as shown in FIGS. 6-8. Similar to ANT A 105, tuning element 136 may be an inductor with a fixed value, or an inductor and capacitor with fixed values (in series or in parallel). The capacitor may be replaced with a continuously variable capacitor or a discretely switched capacitor network for multi-band frequency tuning. The continuously variable capacitor may be composed, but not limited to, one or more varactors, Ferro-electric capacitors, or analog MEM capacitors.

ANT C 145 includes metal strip elements 150*a*, 150*b* and tuning element 156 to form a loop small enough to fit within the physical constraints of ANT B 125. An RF feed port for ANT C 145 is composed of two contacts 154*a* and 154*b*. ANT C 145 may be rotated along the z-axis while maintaining an orthogonal orientation relative to ANT A 105 and ANT B 125 in other exemplary embodiments (not shown).

Metal strap 152 is connected between metal strip elements 150*a* and 150*b* to form a matching circuit between RF feed port contacts 154*a* and 154*b*. Metal strap 152 may be replaced with a lumped element inductor connected between RF feed port contacts 154*a* and 154*b*, however, the electrical loss of the metal strap 152 is much lower than a lumped element inductor and the radiated efficiency of ANT C 105 may suffer some degradation if a lumped inductor element is used.

Tuning element 156 is a capacitor with a fixed value (lumped capacitor element) or adjustable (using a continuously variable capacitance or a discretely switched capacitor network) depending on the operating band requirements for ANT C 145 as shown in FIGS. 6-8. Similar to ANT A 105 and ANT B 125, tuning element 156 may be an inductor with a fixed value, or an inductor and capacitor with fixed values (in series or in parallel). The capacitor may be replaced with a continuously variable capacitance or a discretely switched capacitor network for multi-band frequency tuning. The continuously variable capacitor may be composed, but not limited to, one or more varactors, Ferro-electric capacitors, or analog MEM capacitors.

In alternate exemplary embodiments, wireless communication device 10 (from FIG. 2) and multi-band antenna array 100 may include two orthogonal antennas instead of three if only two simultaneous operating modes (WAN+GPS, WAN+Bluetooth, etc) or dual-diversity is required for either transmit or receive (EVDO, 802.11, etc). Additionally, there may be multiple antennas that are not orthogonal to multi-band antenna array 100 depending on how many radios are supported by wireless communication device 10 or there may be several multi-band antenna arrays (100) in applications such as portable computers with combinations of 802.11n, Bluetooth, UWB, and WAN communication links.

Wireless communication device 10 utilizes multiple antennas (as depicted in multi-band antenna array 100) with simultaneous operating modes in the same or separate frequency bands. As a result, the combination of multiple antennas and simultaneous operating modes creates significant design challenges for the wireless communication device 10 and multi-band antenna array 100. A substantial improvement in antenna radiation efficiency allows multi-band antenna 100 to replace the functionality of multiple single-band antennas for different frequency bands and reduce the size of the antenna system for wireless communication device 10; thereby circuit board floor-plan and layout are simplified, wireless communication device 10 size is reduced, and ultimately the wireless communication device 10 features and form are enhanced. Secondly, the multi-band antenna array 100 provides isolation between antenna elements (ANT A 105, ANT B 125, and/or ANT C 145), allowing up to three simultaneous operating modes in one, two, or three operating frequency bands with minimal additional volume over a single antenna configuration.

FIG. 3 shows an overhead view (XY plane) of ANT A 105 in FIG. 2. As discussed in reference to FIG. 2, ANT A 105 includes metal strip elements 110*a*, 110*b* and tuning element 116 with a tuning input 117 (alternately called ANT A FREQ in FIG. 1 and FIG. 3, optional) to form a physical loop antenna structure with overall XY dimensions of LA and HA. The width of the metal strips 110*a* and 110*b* are defined as WA and can be adjusted based on operating band, impedance, and antenna efficiency. Unless formed in free-space, the physical structure of ANT A 105 needs to be supported by substrate 118. Substrate 118 is composed of a thin dielectric material to reduce the physical size of ANT A 105 (dielectric constant>1) and provide physical support for metal strips 110*a* and 110*b*, tuning element 116 and metal strap 112 (which may be printed on a flexible tape or membrane). As discussed previously in connection with FIG. 2, metal strap 112 may be replaced with a lumped element inductor connected between 114*a* and 114*b* at the expense of reduced radiated efficiency for ANT A 105.

ANT A 105 may include an optional matching circuit A 120 to facilitate impedance matching with wireless communication device RF port A 122. Optional matching circuit A 120 consists of passive inductor or capacitor elements and may be included on substrate 118 or located anywhere between the RF feed port for ANT A 105 (contacts 114*a* and 114*b*) and the output of RF-Front End 205 (wireless communication device RF port A 122) from FIG. 1.

Although not shown in FIG. 2 for simplicity, ANT A 105 of FIG. 3 includes slots and notches cut out in substrate 118 (gap equal to T with lengths LB and LC) to accommodate ANT B 125 and ANT C 145. Additional electrical, mechanical, and chemical features may be added to hold ANT A 105, ANT B 125, and ANT C 145 together and couple RF signals to/from each loop antenna element from RF Front-End 205 shown previously in FIG. 1 (wireless communication device RF port A 122).

ANT A 105, ANT B 125, and ANT C 145 may also be held together by an electrically RF transparent supporting structure, such as an un-painted (or non-metallic painted) plastic housing or the like. The slots and notches can be rotated θ degrees (0 to 360) in the XY plane without affecting the coupling between ANT A 105, ANT B 125, and ANT C 145 and allows the physical size of ANT A 105 and ANT B 125 (LB and LC) to be increased by root 2 (relative to θ equal to 0 degrees) if θ equals 45, 135, 225, or 315 degrees.

In this instance, the increased flexibility in ANT B 125 and ANT C 145 dimensions is desired in applications where the frequency bands are close together or overlap. However, as is evident in FIGS. 2-3 and subsequently FIGS. 4-5, rotating ANT B 125 and ANT C 145 may lead to increased signal coupling of the matching circuits (120, 140, and 160) or the RF signals feeding into ANT A 105, ANT B 125, and ANT C 145 (wireless communication device RF port A 122, wireless communication device RF port B 142, and wireless communication device RF port C 162 respectively) where the signal paths to each loop antenna element are in close physical proximity.

FIG. 4 shows an overhead view (YZ plane) of ANT B 125 of FIG. 2 in accordance with an exemplary embodiment. As discussed previously in reference to FIG. 2, ANT B 125 includes metal strip elements 130*a*, 130*b* and tuning element 136 with a tuning input 137 (alternately called ANT B FREQ in FIG. 1 and FIG. 4, optional) to form a physical loop antenna structure with overall YZ dimensions of LB and HB.

The width of the metal strips 130*a* and 130*b* are defined as WB and can be adjusted based on operating band, impedance, and antenna efficiency. Unless formed in free-space, the physical structure of ANT B 125 needs to be supported by substrate 138. Substrate 138 is composed of a thin dielectric material to reduce the size of ANT B 125 (dielectric constant>1) and provide physical support for the metal strips 130*a* and 130*b*, the tuning element 136 and the metal strap 132 (which may be printed on a flexible tape or membrane).

As discussed in FIG. 2 and FIG. 3, metal strap 132 may be replaced with a lumped element inductor connected between RF feed port contacts 134*a* and 134*b* at the expense of reduced radiated efficiency for ANT B 125.

ANT B 125 may include an optional matching circuit B 140 to facilitate impedance matching with wireless communication device RF port B 142. Optional matching circuit B 140 consists of passive inductor or capacitor elements and may be included on substrate 138 or located anywhere between ANT B 125 (134*a* and 134*b*) and the output of RF-Front End 225 (wireless communication device RF port B 142) from FIG. 1.

Although not shown in FIG. 2 for simplicity, ANT B 125 of FIG. 4 includes a slot cut out in substrate 138 (gap equal to T with length HC) to accommodate ANT C 145. Additional electrical and mechanical features may be added to hold ANT A 105, ANT B 125, and ANT C 145 together and couple RF signals to/from each antenna element from RF Front-End 225 shown previously in FIG. 1 (wireless communication device RF port B 142).

FIG. 5 shows an overhead view (XZ plane) of ANT C 145 in accordance with the exemplary embodiment as shown in FIG. 2. As discussed previously in reference to FIG. 2, ANT C 145 includes metal strip elements 150*a*, 150*b* and tuning element 156 with a tuning input 157 (alternately called ANT C FREQ in FIG. 1 and FIG. 5, optional) to form a physical loop antenna structure with overall XZ dimensions of LC and HC. The width of the metal strips 150*a* and 150*b* is defined as WC and can be adjusted based on operating band, impedance, and antenna efficiency. Unless formed in free-space, the physical structure of ANT C 145 needs to be supported by a substrate 158. Substrate 158 is composed of a thin dielectric material to reduce the size of ANT C 145 (dielectric constant>1) and provide physical support for the metal strips 150*a* and 150*b*, the tuning element 156 and the metal strap 152 (which may be printed on a flexible tape or membrane). As discussed in FIG. 2, FIG. 3 and FIG. 4, metal strap 152 may be replaced with a lumped element inductor connected between 154*a* and 154*b* at the expense of reduced radiated efficiency for ANT C 145.

ANT C 145 may include an optional matching circuit C 160 to facilitate impedance matching with wireless communication device RF port C 162. Optional matching circuit C 160 consists of passive inductor or capacitor elements and may be included on substrate 158 or located anywhere between ANT C 145 (154*a* and 154*b*) and the output of RF-Front End 245 (wireless communication device RF port C 162) from FIG. 1.

As shown in the exemplary embodiment of FIGS. 2-5, the operative frequency band or channel of each loop antenna (ANT A 105, ANT B 125, and ANT C 145) may be changed by controlling the capacitance value of tuning elements 116, 136, and 156 with tuning inputs 117, 137, and 157, respectively.

Tuning elements 116, 136 and 156 may be implemented as continuously variable capacitance utilizing a control voltage with digital control signals from processor 400 of FIG. 1 via digital to analog converters (DACs contained within processor 400) or as set of fixed value capacitors that are selected with RF switches utilizing one or more digital control signals (input provided by processor 400) depending on the desired operating band or operating frequency.

Tuning elements 116, 136 and 156 may also be implemented in a variety of circuit topologies which may include inductors, capacitors, diodes, FET switches, varactors, Ferroelectric capacitors, analog MEM capacitors, digital logic and biasing circuits but perform the same function.

FIG. 6 shows a graph of antenna radiated efficiency from 700 to 1600 MHz for a multi-band array with ANT A, ANT B, and ANT C configured as shown in FIGS. 2-5. As is evident from the graph of FIG. 6, the operative frequency bands are 740 MHz (MediaFLO) for ANT A 105, 860 MHz (US CELLULAR) for ANT B 125, and 1575 MHz (GPS) for ANT C 145.

Multi-band antenna array 100 can be configured for different operating frequency bands by adjusting tuning elements 116, 136, and 156 with tuning inputs 117, 137, and 157, respectively, to shift the resonant frequency band for each loop antenna. At any given time, each loop antenna operates in one frequency band and in one frequency mode. However, multiple loop antennas may operate in the same frequency band for receive and/or transmit diversity if properly configured.

FIG. 7 shows a graph of antenna return loss from 700 to 1600 MHz for a multi-band array 100 with ANT A, ANT B, and ANT C configured as shown in FIGS. 2-5. In the example embodiment represented by FIG. 7, the operative frequency bands are matched to 50 ohms. Matching circuits 120, 140, 160 may require digital control signals (from processor 400) to adjust or tune the matching elements (not shown) to maintain a 50 ohm match across a broad range of operating frequencies.

FIG. 8 shows a graph of antenna coupling from 700 to 1600 MHz for a multi-band array 100 with ANT A, ANT B, and ANT C configured as shown in FIGS. 2-5. As is evident from the graph of FIG. 8, the operative frequency bands are where the coupling is the greatest between individual loop antennas. However, because each loop antenna is orthogonal and arranged in an embedded manner relative to the other loop antennas, the overall isolation across a broad range of radio frequencies is excellent given the close proximity (overlapping) between the antenna structures. Further improvements are feasible depending on the physical size of the multi-band antenna array 100 and the relative size of the individual loop antennas (ANT A 105, ANT B 125, and ANT C 145).

Those of skill in the art would understand that information and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof.

Those of skill would further appreciate that the various illustrative logical blocks, modules, circuits, and algorithm steps described in connection with the embodiments disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the exemplary embodiments of the invention.

The various illustrative logical blocks, modules, and circuits described in connection with the embodiments disclosed herein may be implemented or performed with a general purpose processor, a Digital Signal Processor (DSP), an Application Specific Integrated Circuit (ASIC), a Field Programmable Gate Array (FPGA) or other programmable logic device, discrete gate or transistor logic, discrete hardware components, or any combination thereof designed to perform the functions described herein. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

The steps of a method or algorithm described in connection with the embodiments disclosed herein may be embodied directly in hardware, in a software module executed by a processor, or in a combination of the two. A software module may reside in Random Access Memory (RAM), flash memory, Read Only Memory (ROM), Electrically Programmable ROM (EPROM), Electrically Erasable Programmable ROM (EEPROM), registers, hard disk, a removable disk, a CD-ROM, or any other form of storage medium known in the art. An exemplary storage medium is coupled to the processor such that the processor can read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components in a user terminal.

In one or more exemplary embodiments, the functions described may be implemented in hardware, software, firmware, or any combination thereof. If implemented in software, the functions may be stored on or transmitted over as one or more instructions or code on a computer-readable medium. Computer-readable media includes both computer storage media and communication media including any medium that facilitates transfer of a computer program from one place to another. A storage media may be any available media that can be accessed by a computer. By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Also, any connection is properly termed a computer-readable medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. Disk and disc, as used herein, includes compact disc (CD), laser disc, optical disc, digital versatile disc (DVD), floppy disk and blu-ray disc where disks usually reproduce data magnetically, while discs reproduce data optically with lasers. Combinations of the above should also be included within the scope of computer-readable media.

The previous description of the disclosed exemplary embodiments is provided to enable any person skilled in the art to make or use the present invention. Various modifications to these exemplary embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A wireless device for cellular communications, comprising:

a multi-band antenna characterized by three loop antenna elements, each of the three loop elements having different size from one another and arranged to loop orthogonally relative to and within one another; and three tuning elements each associated with a respective one of the three loop antenna elements, where the tuning elements selectively tune each of the loop antenna elements to resonate at different frequencies simultaneously, as well as tune to different frequencies when switching from receive and transmit modes of operation, wherein the selectively tuning by the tuning elements is such as to minimize the size of the three loop antenna elements to allow for a small form factor of the cellular communication device.

2. The wireless device of claim 1, wherein each loop antenna element is split into an upper and lower half with the associated tuning element coupled therebetween.

3. The wireless device of claim 2, wherein each tuning element includes a continuously variable capacitor.

4. The wireless device of claim 2, wherein each tuning element includes a MEMS variable capacitor.

5. The wireless device of claim 2, wherein the multi-band antenna includes matching circuits between at least one radio frequency feed port and at least one wireless communication device radio frequency port.

6. The wireless device of claim 2, wherein the multi-band antenna is printed on separate flexible membranes for each loop antenna element.

7. The wireless device of claim 2, wherein the multi-band antenna apparatus is printed on separate dielectric substrates for each loop antenna element.

8. The wireless device of claim 2, wherein the multi-band antenna apparatus is formed by selective metallization on a three-dimensional non-metal object.

9. The wireless device of claim 1, wherein each tuning element includes a continuously variable capacitor.

10. The wireless device of claim 1, wherein each tuning element includes a MEMS variable capacitor.

11. The wireless device of claim 1, wherein the multi-band antenna includes matching circuits between at least one radio frequency feed port and at least one wireless communication device radio frequency port.

12. The wireless device of claim 1, wherein the multi-band antenna is printed on separate flexible membranes for each loop antenna element.

13. The wireless device of claim 1, wherein the multi-band antenna apparatus is printed on separate dielectric substrates for each loop antenna element.

14. The wireless device of claim 1, wherein the multi-band antenna apparatus is formed by selective metallization on a three-dimensional non-metal object.

* * * * *